United States Patent [19]

Raymond

[11] Patent Number: 5,007,222

[45] Date of Patent: Apr. 16, 1991

[54] FOAMED BUILDING PANEL INCLUDING AN INTERNALLY MOUNTED STUD

[76] Inventor: Harry W. Raymond, 203 Richey St., P.O. Box 395, Lock Haven, Pa. 17745

[21] Appl. No.: 370,988

[22] Filed: Jun. 23, 1989

Related U.S. Application Data

[63] Continuation-in-part of Ser. No. 273,760, Nov. 14, 1988, Pat. No. 4,862,660, which is a continuation of Ser. No. 72,718, Jul. 13, 1987, abandoned.

[51] Int. Cl.[5] ..... E04B 1/76; E04B 2/00; E04C 2/34; E04C 2/26

[52] U.S. Cl. ..... 35/586; 52/221; 52/731

[58] Field of Search ..... 52/586, 238, 221, 243, 52/396, 730, 731, 732

[56] References Cited

U.S. PATENT DOCUMENTS

| | | | |
|---|---|---|---|
| 1,990,656 | 2/1935 | Kotrbaty | 52/243 |
| 2,228,052 | 1/1941 | Gardner | 52/396 |
| 2,901,904 | 9/1959 | Wey | 52/396 |
| 3,359,022 | 12/1967 | Russell | 52/586 |
| 3,512,819 | 5/1970 | Morgan | 52/586 |
| 3,685,222 | 8/1972 | Curtess | 52/586 |

*Primary Examiner*—John E. Murtagh

*Attorney, Agent, or Firm*—Mason, Fenwick & Lawrence

[57] ABSTRACT

An integral energy efficient load-bearing exterior wall fabricated of light-weight foam surrounding plastic load-bearing columns. The invention relates to pre-fabricated modular wall panels as individual building elements and as part of an integrated building system. In a preferred embodiment, a prefabricated modular wall panel is made from a foamed material that is molded around a plurality of vertically disposed hollow support columns. Each of the columns contains a pair of opposed and vertically disposed T-shaped fastening supports which are arranged to form part of the interior and exterior surfaces of the foamed wall. The hollow columns are set onto locking base plates which are mounted on a wood or concrete deck system. Locking top plates are also mounted on wood and are then placed on top of the columns. The tubular columns are made of a plastic material and are shaped in cross-section in the form of a rectangle, square, diamond, oval or circle. The hollow columns may be used as conduits for electrical wiring, water pipes and in certain cases can be fabricated to act as heat or air-conditioning ducts.

12 Claims, 6 Drawing Sheets

FOAMED BUILDING PANEL INCLUDING AN INTERNALLY MOUNTED STUD

CROSS REFERENCE TO RELATED APPLICATION

This application is a continuation-in-part of my pending Ser. No. 273,703, filed Nov. 14, 1988 now U.S. Pat. No. 4,862,660, which is a continuation of Ser. No. 072,718, filed Jul. 13, 1987, and now abandoned.

BACKGROUND OF THE INVENTION

This invention relates to construction panels for structural support systems having high strength to weight ratios and excellent insulating properties. The construction panels are primarily for use as exterior walls but may also be used for interior walls, partitions, ceilings and the like.

Currently, buildings are being constructed from a wide variety of materials. Among the more common are wood, cinder block, brick, concrete, metal and glass. Each has particular advantages and disadvantages. Wood, while relatively easy to work with, is flammable, requires the labor of skilled carpenters, and is becoming increasingly expensive. Cinder block and brick, although quite durable are quite heavy, thus requiring high transportation costs. In addition, working with brick and block requires the attention of skilled masons over long periods of time. Concrete is awkward to transport, comparatively expensive and requires the use of special construction techniques and building equipment. Metal panels are poor insulators and require the services of welders, riveters or other personnel to fasten the panels together and to the supporting structure by bolts, rivets or the like. Glass is breakable, hard to transport and is not a good insulator. Because of these disadvantages, new materials have been and are being developed to replace the traditional building materials.

Recently some states have passed new laws mandating that new structures must meet certain energy efficiency standards including high "R" value insulation standards. Additionally, the cost of lumber is escalating and natural resources are being depleted. Proper insulation of a building leads to conservation of both energy and natural resources while at the same time meeting the new energy efficiency standards being written into law.

Various prior art methods of insulating buildings have been proposed. The most common form of insulation is foilbacked fiberglass. Rolls of this material having various degrees of thicknesses are unrolled at a job site, cut to size and then mounted between adjacent wall studs. For preconstructed structures, insulating material may be blown between the outer facing and the inner walls of a building to the desired density and R value.

Another technique of providing adequate insulation for buildings is to incorporate insulating material in prefabricated building panels. These panels offer the advantages of good insulating properties, mass production, and ease of on-site assembly of the panels, among other. These panels generally comprise a core of insulating material surrounded by structurally rigid panels. The core of insulating material may comprise balsa wood, glass wool, foamed or expanded polymeric materials such as polystyrene, polyvinyl chloride, polyurethane, etc. The core material may be surrounded by panel members comprising first and second major face members and side and end walls of such materials as plywood, metal, resin and resin reinforced with fibrous glass rovings, etc. Generally, these panels are strong, lightweight and provide proper insulating properties while using less wall space.

These modular panels also have some disadvantages. Since the foam used in forming the core is not elastic, once it is compressed, a space develops between the core and facing member. This results in weakened structural integrity and may be responsible for such conditions as warping, buckling and cracking of the face member or of the entire panel. An additional disadvantage is that the major face members generally cannot withstand a great amount of load-bearing pressure as may be encountered when the panels are used as load-bearing members. To make the panels stronger, various reinforcing means have been incorporated within them. U.S. Pat. No. 4,078,348 (Rothman) includes a discussion of patents that are representative of the way in which the prior art has attempted to overcome the problems and disadvantages associated with foamed core sandwich-type panels.

U.S. Pat. No. 4,163,349 (Smith) shows an insulating building panel including an insulating core and having an exterior skin on one side and an interior skin on the other side. The skins overlap the core about its periphery and, at the sides of the panel, extend from the core a distance to receive a portion of a bearing post to which adjacent panels are connected. U.S. Pat. No. 4,567,699 (McClellan) relates to a prefabricated building system made up of a plurality of prefabricated panels. Each panel includes a formed body of insulating material having a top, a bottom, sides, a front face and a back face. At least one hollow tubular load-bearing member is embedded in the body intermediate the sides and faces thereof and extends vertically between the top and bottom. The tubular load-bearing member has a slot in the top and bottom. The slots have their axis generally parallel to the front and rear faces of the body. A bottom member is provided along the floor and has an upstanding flange extending into the slot of the bottom of the tubular member and a top member extends along the top of the panels and has a flange extending downwardly into the slots in the top of the tubular load-bearing members. The load-bearing members have a length greater than the length of the body so that vertical loads are not transmitted to the body.

Additional examples of modular wall sections employing foam insulation are shown in U.S. Pat. Nos. 3,828,502 (Carlsson); 3,791,912 (Allard); 3,562,985 (Nicosia) and 3,449,879 (Bloom).

Despite the several alternatives for providing prefabricated panels in building systems, there is still a need for a construction panel and building system which is less expensive to produce because of conservation of materials, requires less labor for erection at the work site, costs less to transport to the work site and minimizes energy losses. The present invention is directed toward filling that need.

SUMMARY OF THE INVENTION

The present invention relates to an integral energy-efficient load-bearing exterior wall fabricated of lightweight foam surrounding plastic load-bearing columns. The present invention includes both the prefabricated modular wall panels as individual elements and as part of an integrated building system.

In a preferred embodiment of the subject invention, a prefabricated modular wall panel is made from a foam material which is molded around a plurality of vertically oriented hollow support columns. Each of the columns contains a pair of vertically disposed T-shaped fastening supports extending along the full length of the support column. The fastening supports are arranged to form part of the interior and exterior surfaces of the foam wall. The hollow support columns, which are preferably made of a vinyl plastic, are set onto locking base plates that are mounted on a wood or concrete deck system. Locking top plates are also mounted on wood are then placed on top of the columns.

In alternative embodiments, the hollow support columns are shaped in cross-section in the form of a rectangle, a square, a diamond, an oval and a circle. The hollow columns are designed to be used as conduits for electrical wiring, water pipes and in certain cases can be fabricated to act as heat or air conditioning ducts.

It is thus a primary object of the present invention to provide a one-piece exterior wall construction which is fabricated from lightweight foam and includes plastic load-bearing columns.

It is another object of the present invention to provide an internally mounted stud for use in a prefabricated wall system.

It is still another object of the present invention to provide a prefabricated construction panel having a high strength to weight ratio.

It is yet another object of the present invention to provide a prefabricated insulated construction panel exhibiting excellent insulating properties.

It is a further object of the present invention to provide a prefabricated construction wall and building system capable of easy on-site assembly.

It is still a further object of the present invention to provide a modular wall system which is capable of easy mass production.

It is yet a further object of the present invention to provide a modular wall system resistant to rot, decay, termites, woodbores, etc.

It is another object of the invention to provide a modular wall system that is warp-resistant and free of knots.

These and other objects will become apparent from the following drawings and detailed description.

DETAILED DESCRIPTION OF THE PREFERRED EMBODIMENTS

Figure 1:
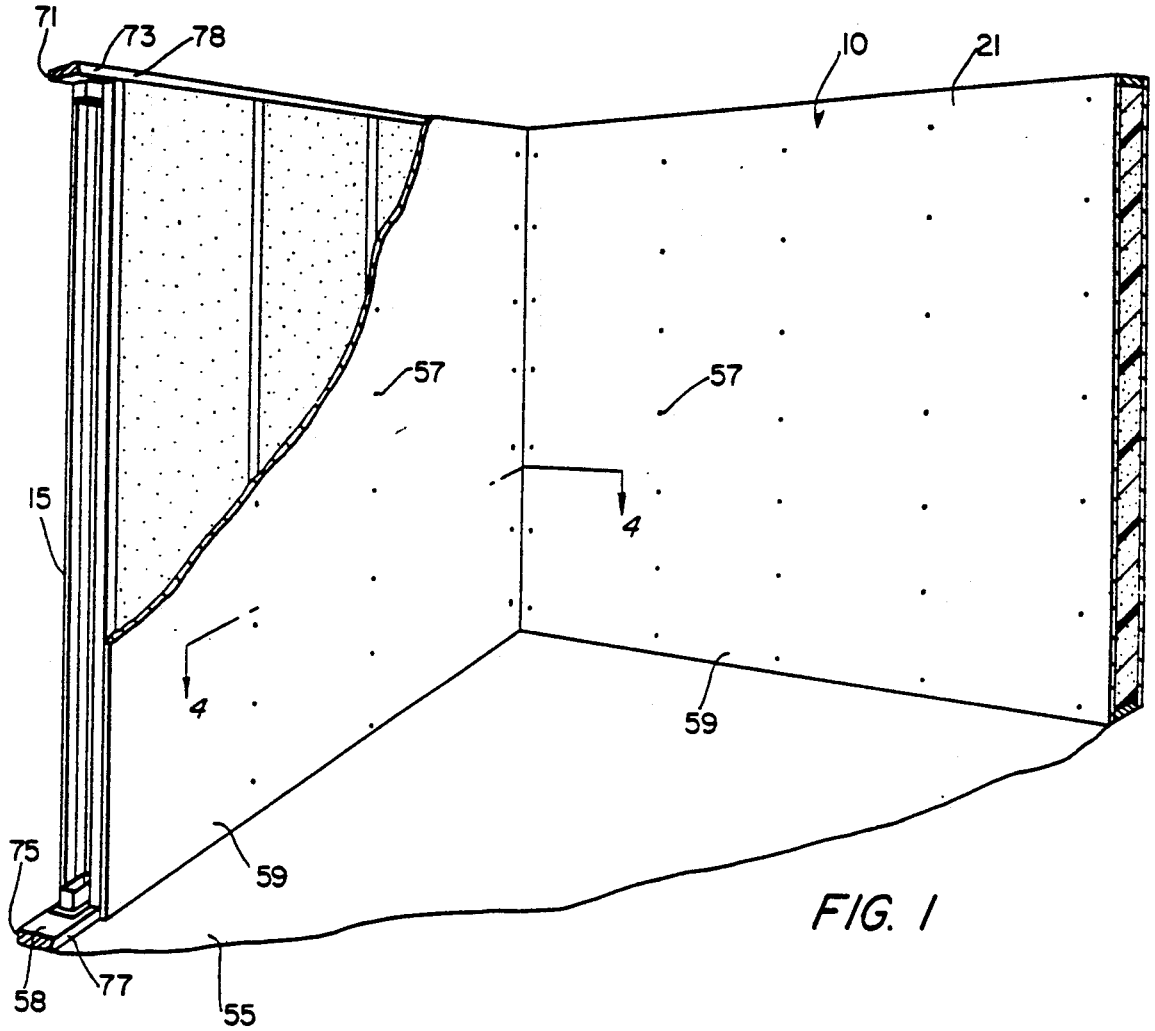
FIG. 1 is a perspective view, partially cut away, of a portion of a building made up of pre-fabricated wall panels forming part of the inventive integrated building system.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIGS. 1 through 6 illustrate a portion of a building incorporating modular wall sections 10 embodying the teachings of the present invention. One modular wall panel 10 basically comprises a wall member 12 made from a foamed plastic material so that the member is principally designed for use as an exterior wall and thus has an exterior wall surface 14 and an interior wall surface 16 which are arranged parallel to each other. As oriented in FIGS. 1 and 3, each wall panel has a predetermined vertical height which approximates the height of an exterior wall normally found in industrial, commercial and residential buildings. Because the panels are made from foamed plastic, the panel size may be easily altered by workmen at the construction site.

Figure 2:
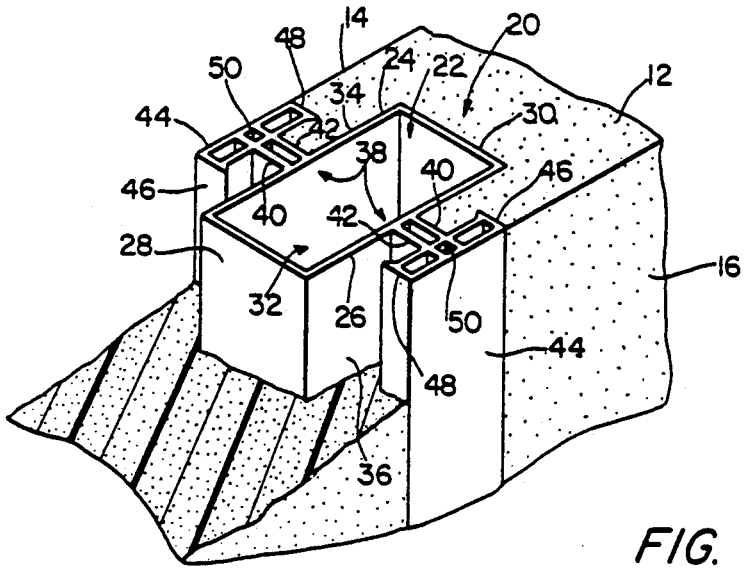
FIG. 2 is a perspective view, partially cut away, showing the details of a vertically disposed hollow column incorporating the teachings of the present invention.
Figure 3:
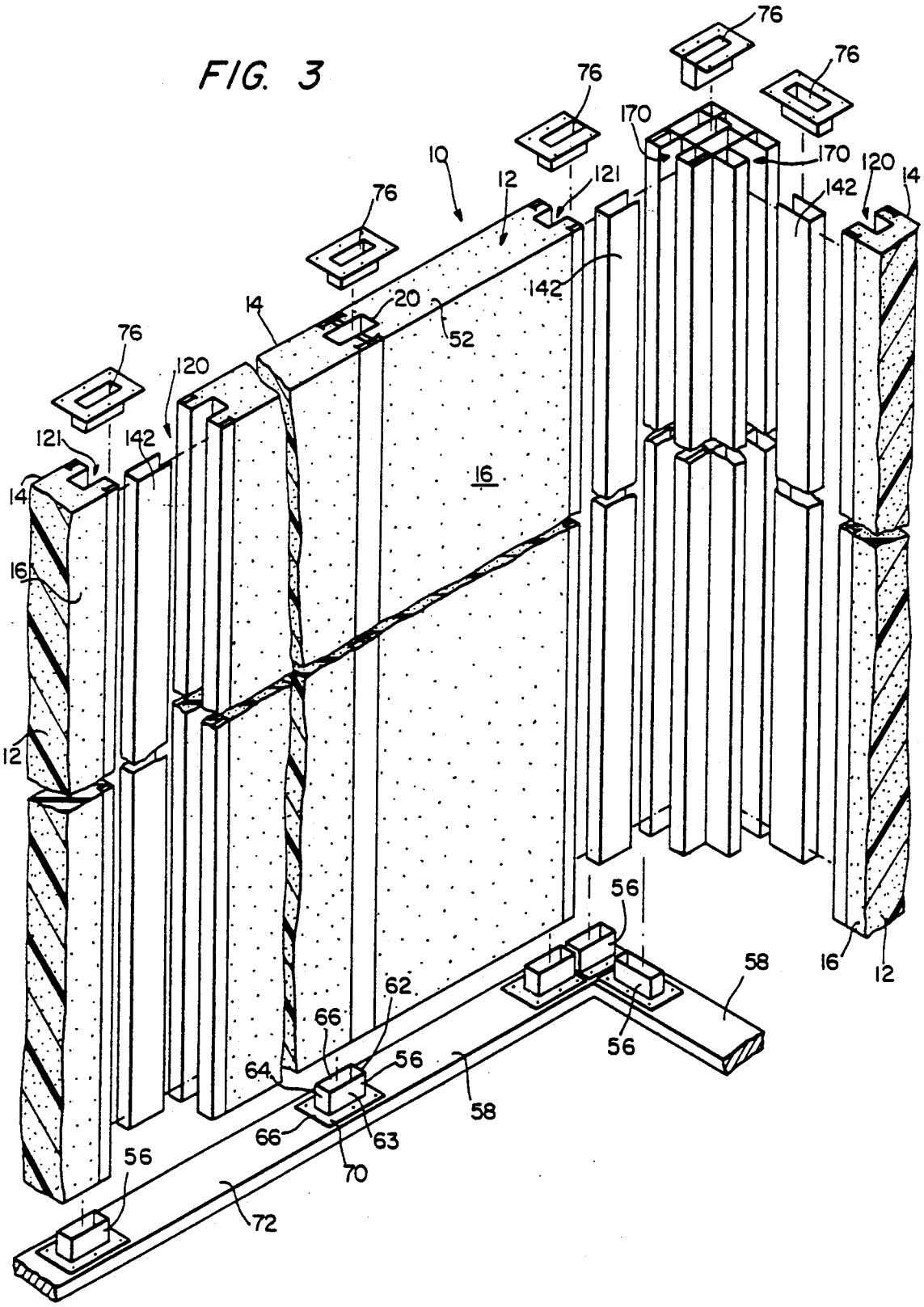
FIG. 3 is an exploded perspective view of the elements constituting the inventive integrated building system.

Vertically disposed within the foamed wall panel 12 are a series of spaced, hollow studs or support columns 20. With reference to FIGS. 2 and 3, a hollow stud 20 is fabricated from a plastic vinyl such as PVC through an extrusion process. The stud basically comprises an elongated, hollow member. In a preferred embodiment as shown in FIGS. 2 and 3, the hollow member when viewed in cross-section is in the shape of a rectangle 22 that is defined as having a pair of opposed elongated walls 24 and 26 which are arranged to be generally parallel with the exterior and interior wall surfaces 14 and 16 when the column is in its position of intended use within wall panel 12. The cross-section is completed by a pair of opposed shorter walls 28 and 30 which are opposed from each other in a generally parallel relationship. Together the interior surfaces of the four walls 24, 26, 28 and 30 define an interior space or volume 32 that exists throughout the entire length of the column. Wall 24 contains an outside face 34 and wall 26 contains an outside face 36. Each of these faces contains the same structure which is described as follows. Using face 34 as exemplary, emanating from an area 38 defined vertically along the mid-point of face 24 are a pair of outwardly extending legs 40 and 42 which are arranged generally parallel to each other. These legs each define an elongated planar wall that is generally perpendicular to surface 24 and extends vertically along the entire length of the column. Each of legs 40 and 42 terminate a predetermined transverse distance from surface 24. Positioned at the termination of legs 40 and 42 is a planar strip 44 that is generally parallel to surface 24 along the full length of the column. Planar strip 44 terminates at its longitudinal side in two inwardly directed side fingers 46 and 48. An inside vertical strip 50 is positioned generally parallel and spaced from strip 44 and acts to join portions of fingers 46, 48 and legs 40 and 42 together. When viewed in cross-section as shown in FIG. 2, the structure just described resembles a T with the head 44 of the T defining a portion of the outer surface 14 of the wall panel and the base of the T being secured to the vertical surface 24 of the hollow column. A similar structural element is defined on face 26 in approximately the same place as the element defined on face 24 and thus contain the same reference numerals.

With reference to its orientation in FIGS. 1 and 3, the wall member 12 terminates at its top in a planar face 52 and at its bottom in planar face 54. The distance between planar face 52 and 54 as measured vertically along one of the columns 20 is approximately equal to the intended height of the finished wall. To complete the construction of the wall member 10, a plurality of locking base plates 56 are secured along a base stud 58 that is made of wood. In a preferred embodiment, the base stud 58 has a width that is substantially equal to the thickness of wall 12.

Figures 4, 5, 6:
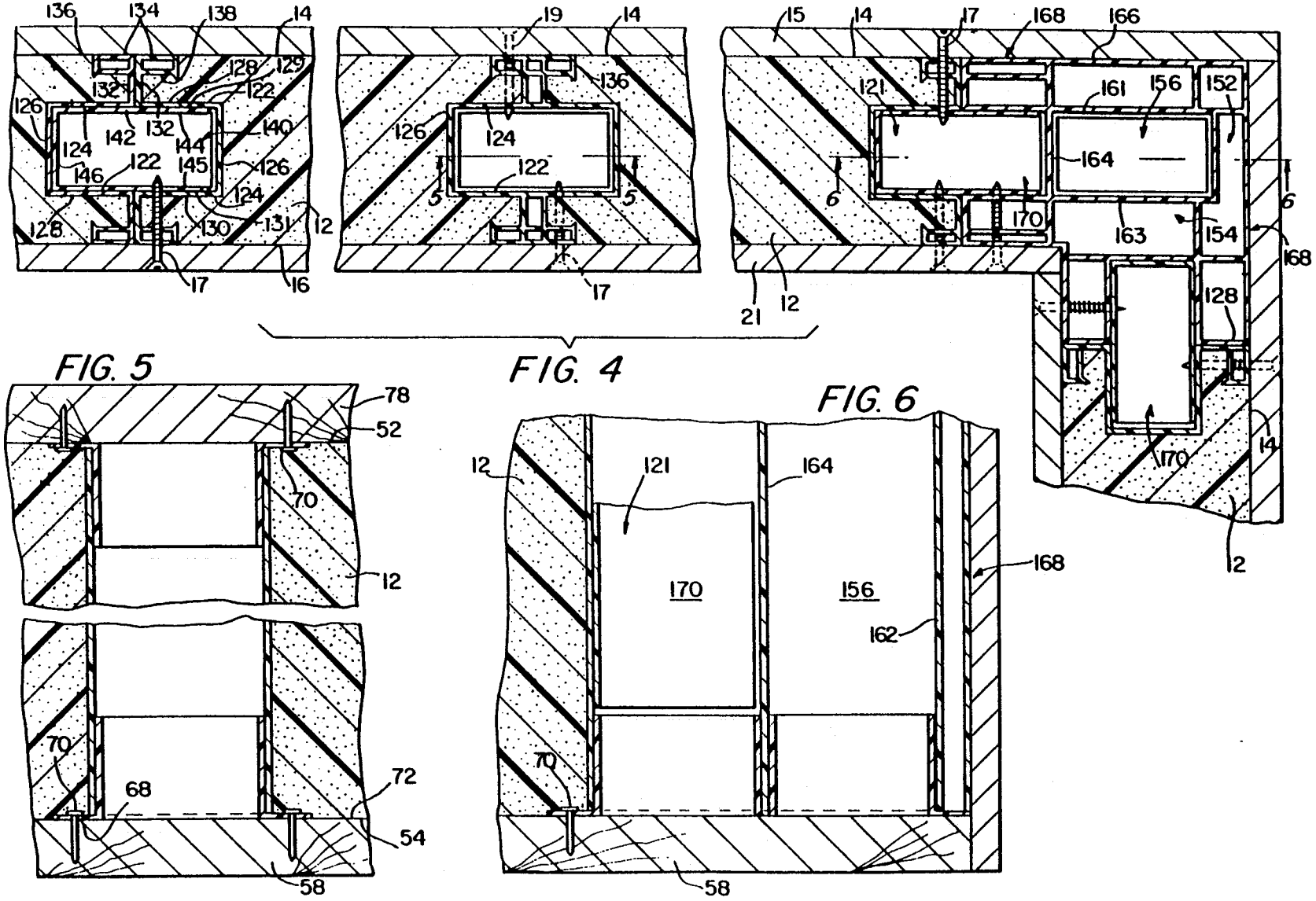
FIG. 4 is a view taken along lines 4—4 of FIG. 1.
FIG. 5 is a view taken along lines 5—5 of FIG. 4.
FIG. 6 is a view taken along lines 6—6 of FIG. 4.

As shown in FIG. 3, each of the base plates is defined by four walls 61 through 64 that are joined together in a figure with an outer periphery that is slightly smaller and mating with the interior configuration of the hollow member 20 so that the hollow member may be placed on top of and receive the locking base plate 56 as shown in FIGS. 5 and 6. Surrounding the bottom periphery of each base plate is a flange 66. The flange contains a number of apertures 68 for a receiving fastening device such as nails 70 in order to secure the locking base plate at a predetermined position along the surface 72 of stud 58.

As can be seen with reference to FIGS. 3 and 5, locking base plates 56 are spaced along the surface of stud 58 so that surface 72 may be placed in intimate contact with surface 54 of wall section 12. The top of wall section 12 is completed through the use of spaced locking top plates 76 and wooden stud 78 in a manner similar to that described with reference to the locking base plate 56 and the bottom stud 58. The locking base and top plates 56 and 76 are secured within hollow column 20 through use of an appropriate adhesive such as that commonly used to secure PVC articles or with a mechanical fastener, such as a screw or nail.

With reference to FIGS. 3 and 4, the way in which the ends of two panels 10 are joined together is graphically illustrated. Each of the wall sections 12 terminate at its vertical edges in end columns 120 and 121. As shown in FIG. 4, each of the end columns when viewed in cross-section generally resembles one-half of the T member cross-section of column 20. When viewed in cross-section, end column 120 has a pair of opposed planar walls 122 and 124 which are arranged to be generally parallel with the exterior and interior wall surfaces 14 and 16 when the column is its position of intended use at the edge of wall panel 10. The cross-section is completed by planar wall 126 which joins the ends of walls 122 and 124 into a generally U-shaped member. Wall 122 contains an outside face 128 and an inside face 129 and wall 124 contains an outside face 130 and an inside face 131. Each of outside faces 128 and 130 contains the same structure which is described as follows. Using face 128 as exemplary, emanating from the free end of wall 122 of the U-shaped section is an outwardly extending leg 132. The leg defines an elongated planar wall that is generally perpendicular to surface 128 and extends vertically along the entire length of the column. Leg 132 terminates a predetermined transverse distance from surface 128. Positioned at the termination of leg 132 is a planar strip 134 that is generally parallel to surface 128 along the full length of the column. Planar strip 134 terminates along its free end in an inwardly directed finger 136. An inside vertical strip 138 ,is positioned generally parallel and spaced from strip 134 and acts to join leg 132 to finger 136. A similar complementary structure is defined for end column 121 and noted by the same reference numerals.

When the planar surfaces of legs 132 of end columns 120 and 121 are placed into intimate contact with each other, the two end columns define an interior space 140 that is of the same size and configuration at the interior space 32 of one-piece column 20.

In order to secure the end columns 120 and 121 to each other, a U-shaped insert 142 is employed. The insert, which in a preferred embodiment, is extruded from a plastic such as PVC extends throughout the entire length of the end columns with the exception of a predetermined space near the bottom and top of the column to leave room for insertion of the base and top plates 56 and 76. When viewed in cross-section, the generally U-shaped member 142 contains two elongated planar wall sections 144 and 145 which are arranged generally parallel and spaced from each other. The two walls are joined together to form the U-shape by a shorter wall 146 which is perpendicular to the other two walls.

The U-shaped insert 142 is sized to fit snugly within the interior area of the end columns 120 and 121. As shown in FIG. 5, the U-shaped insert facilitates securing and joining of the two wall sections 12. The U-shaped wall member may either be glued within the end columns or fastened through the use of screws 17 or nails 19.

Figure 8:
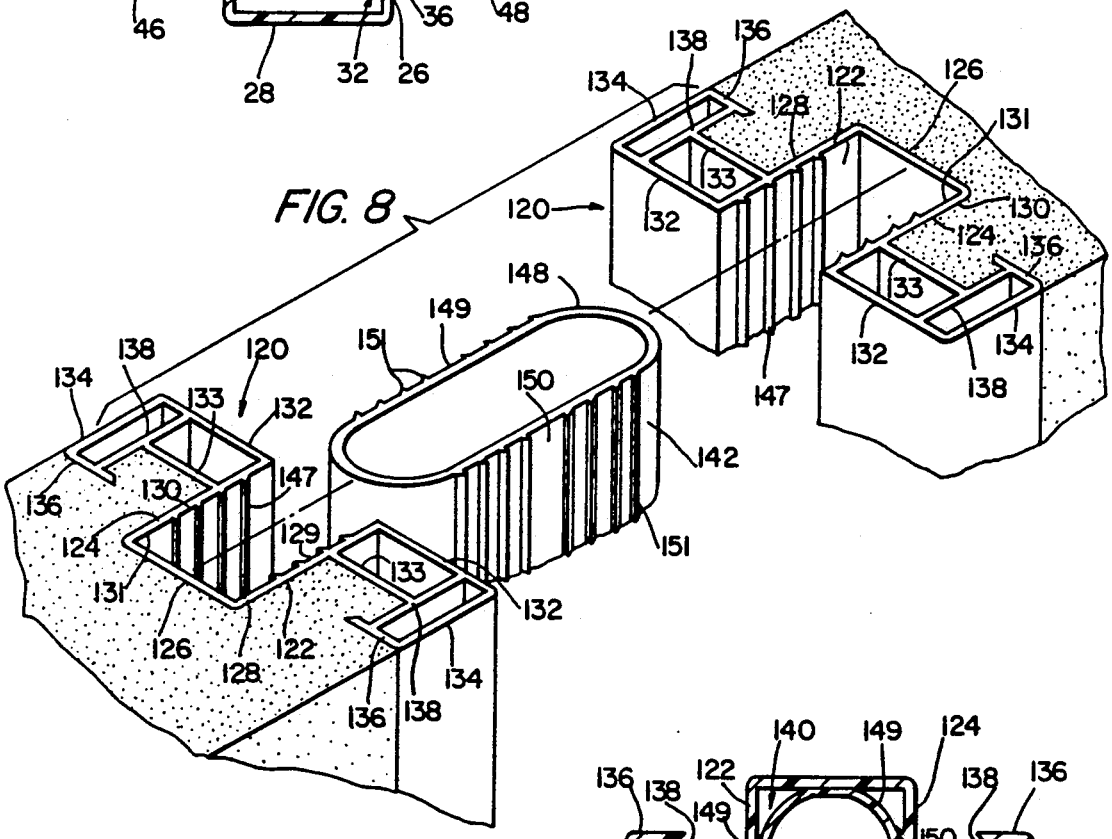
FIG. 8 is an exploded perspective view of another embodiment of the elements of FIG. 3 used to join the ends of two panels.
Figure 9:
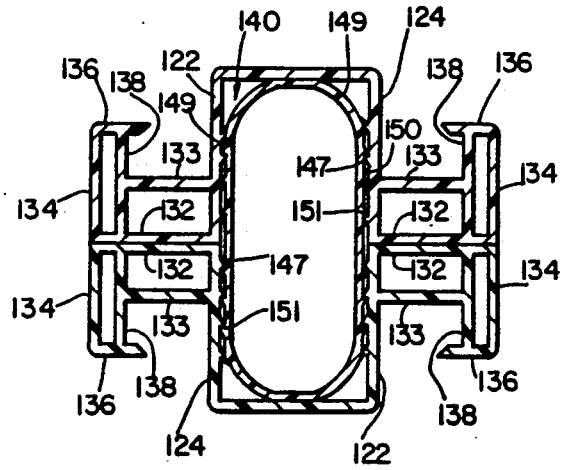
FIG. 9 is plan view showing the details of the elements of FIG. 8.

In an alternative embodiment, shown in FIGS. 8 and 9, a second leg 133 is provided parallel to leg 132 and offset from the free end of wall 122 or 124. Also, inside faces 129 and 131 of end columns 120 and 121 are each provided with longitudinal barbs 147 angled towards the end walls 126. End columns 120 and 121 are secured to each other by an insert 142 having an ellipsoidal transverse cross-section. Insert 142 has an outer surface 148 having substantially planar, parallel side sections 149 and 150. These sections 149 and 150 are provided with longitudinal barbs 151 angled towards the minor transverse axis of insert 142. Barbs 147 extend the entire length of end columns 120 and 121, and barbs 151 extend the entire length of insert 142. The inside end-to-end dimensions of end columns 120 and 121 when joined together is somewhat smaller than the outside end-to-end dimension of insert 142. End columns 120 and 121 can thus be press-fit over the ends of insert 142, causing sections 149 and 150 to bow outwardly and barbs 151 to bite into and lockingly engage barbs 147 to secure end columns 120 and 121 together. Glue, screws, nails, or other extraneous fastening means are thus unnecessary, although they can be used if desired.

Figure 7:
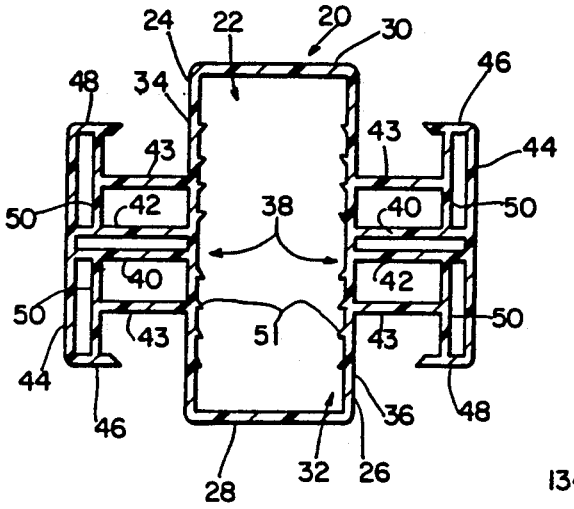
FIG. 7 is a plan view showing the details of another embodiment of the hollow column of FIG. 2.

End columns 120 and 121 and insert 142 are extruded from a plastic such as PVC. End columns 120 and 121 can be extruded individually. Alternatively, a hollow column 20 as shown in FIG. 7 can be cut in half and the inner edges trimmed to form end columns 120 and 121. Column 20 as shown in FIG. 7 is similar to column 20 shown in FIGS. 1–6 except for the provision of barbs 51 and outer legs 43, and an interruption in vertical strip 50 between legs 40 and 42, and is also formed from an extruded plastic such as PVC.

FIGS. 3, 4 and 6 generally show the way that wall sections 10 are joined together at corners. A vertically oriented corner column is shown and designated as 152. In a preferred embodiment, the corner column 152 is extruded as a one-piece plastic unit incorporating three basic sections. At the heart of the corner column is a column defining area 154 which contains several vertically oriented walls 161 through 164 that are joined together in order to define an opening 156 that is the same size and shape as the opening 32 defined in vertical column 20. This is done so that the column 156 is able to receive the base and top plates 56 and 76 in a manner described hereinbefore with reference to space 32 of vertical column 20.

Spaced from wall 161 is an exterior corner wall 166 that is intended to lie in the same plane and define a portion of exterior wall 14. In a similar manner, spaced from wall 162 is another planar wall 168 that contributes to defining the other corner wall and lies in the same plane as exterior surface 14 for an adjacent wall member 12.

Corner column 152 terminates at each end in an end column defining portion 168. The portion is constructed to define an interior area 170 that is of the same size and shape as the interior wall defined by edge members 120 and 121 so that when the corner column 152 is joined into operative contact with one of those members an interior space of proper size for receiving the bottom and top plates 56 and 76, as well as the U-shaped joining member 142, is provided.

FIGS. 1 and 3 show a number modular wall units 12 arrange in their position of intended use. As can be seen, the wall units 12 are erected in vertical fashion with the undersurface of base stud 58 in contact with the floor 55 or foundation of the building or dwelling. The wooden construction of the base and top studs 58 and 78 facilitate attachment of each wall member 10 to the building under construction. The wall is erected near the perimeter of the structure so that the wall 14 defines an exterior wall and the wall 16 defines and interior wall. The flat surfaces 44 of each of the columns 20 define an area along both surfaces 14 and 16 for receiving fastening devices such as nails or screws 57 to secure the appropriate type of wall covering 59 or skin to complete the construction of the modular wall member 10. The side surfaces 71 and 73 of top stud 78 and the side surfaces 75 and 77 of bottom stud 58 also occupy the same plane as faces 44 of columns 20 for facilitating attachment of the skin. The same relationship holds true for surface 134 of end columns 120 and 121 and corner surfaces 166 and 168 of corner column 152. As shown in FIG. 4, the exterior surface 14 receives a sheet of plywood siding 15 which is fastened by chemical bond (adhesive) or by mechanical fastener such as screws 17 or nails 19 to the various faces 44, 134 and 168 of columns 20, 120, 121 and 152, respectively, and the side surfaces of the top and bottom studs 78 and 58. To complete the construction of the interior surface, drywall or paneling 21 is secured in a similar fashion.

Figure 10:
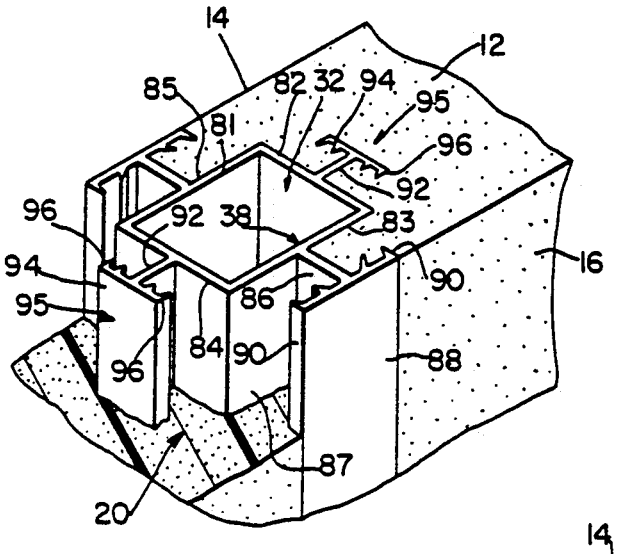
FIG. 10 is a perspective view, partially cut away, showing the details of another embodiment of the hollow column of FIG. 2.
Figure 11:
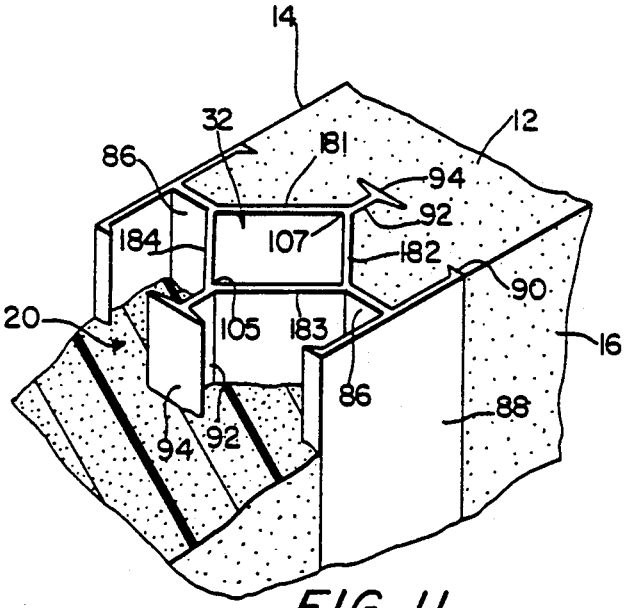
FIG. 11 is a perspective view, partially cut away, showing the details of yet another embodiment of the hollow column of FIG. 2.
Figure 12:
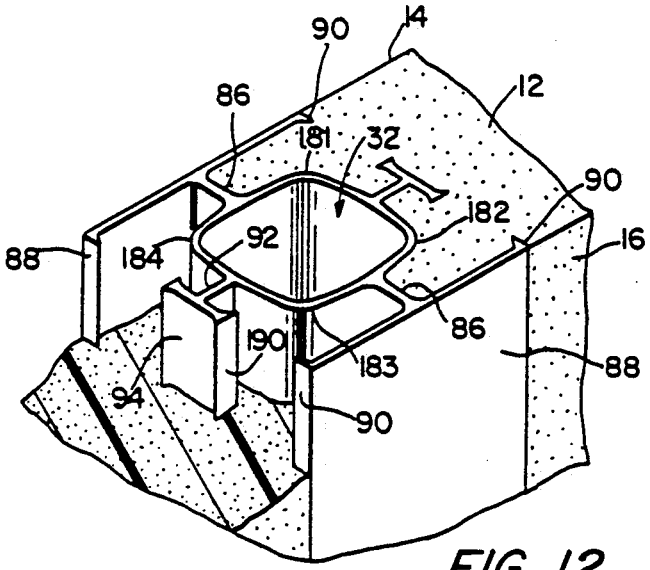
FIG. 12 is a perspective view, partially cut away, showing the details of still another embodiment of the hollow column of FIG. 2.

FIGS. 10 through 12 show in cross-section alternative configurations for the hollow column 20. In an alternative preferred embodiment as shown in FIG. 10, the hollow member when viewed in cross-section is generally shaped like a square that is defined as having a pair of opposed walls 81 and 83 which are arranged to be generally parallel with the exterior and interior wall surfaces 14 and 16 when the column is in its position of intended use. The cross-section is completed by a pair of walls 82 and 84 which are opposed from each other in a generally parallel relationship. Together the interior surfaces of the four walls 81, 82, 83 and 84 define the interior space 32. Wall 81 contains an outside face 85 and wall 83 contains an outside face 87. Each of these faces contains the same structure which is described as follows. Using face 83 as exemplary, emanating from an area 38 defined vertically along the mid-point of face 83 is a vertically extending leg 86. The leg defines a planar wall that is generally perpendicular to surface 87. Leg 86 terminates a predetermined transverse distance from surface 87. Defined at the termination of leg 86 is a planar strip 88 that is generally parallel to surface 87. Planar wall 88 terminates at its sides in two inwardly directed side fingers 90. When viewed in cross-section as shown in FIG. 10, the structure just described resembles a T with the head 88 of the T defining a portion of the outer or inner surface 14 or 16 of the wall panel 12 and the base of the T being secured to the vertical surface 87 of the hollow column. A similarly configured element is defined on face 85 in approximately the same place as the element defined on surface 87. The outer face of walls 82 and 84 contain T structures 95 that are smaller than the T-structure emanating from surface 85. In the several T-structures, leg 92 resembles to leg 86, wall 94 resembles to wall 88 and fingers 96 resemble to fingers 90.

In still another preferred embodiment as shown in FIG. 11, the hollow member when viewed in cross-section is in the shape of a diamond that is defined as having a pair of opposed walls 181 and 183 which are arranged at about a 45° angle with the exterior and interior wall surfaces 14 and 16. The cross-section is completed by a pair of opposed walls 182 and 184 which are opposed from each other in a generally parallel relationship. Together the interior surfaces of the four walls 181, 182, 183 and 184 define the interior space 32. A side of wall 181 meets with a side of wall 184 at a corner 101 near surface 14 of wall 12. Similarly, a side of wall 182 meets with a side of wall 183 at a corner 103 near surface 16 of wall 12. Emanating from corner 101 as defined vertically along column 20 is leg 86. The leg defines a planar wall that is generally perpendicular to surface 14 of wall 12. Leg 86 terminates a predetermined transverse distance from corner 101. Defined at the termination of leg 86 is a structure similar to that shown in FIG. 10. Inner corners 105 and 107 of the column include structural elements 92 and 94 as previously described with reference to the embodiment in FIG. 10 without the fingers 96.

Finally, FIG. 12, shows another embodiment of the vertical columns which when viewed in cross-section resembles the square embodiment of FIG. 10 with rounded corners 181 through 184. For this reason, like elements contain like reference numerals. However, certain mirror differences are noted. In particular, the fastener strip 88 is much wider in the oval embodiment than in the square embodiment. Likewise, the inward fingers 96 are replaces by fingers 190 that extend both inwardly and outwardly.

Figure 13:
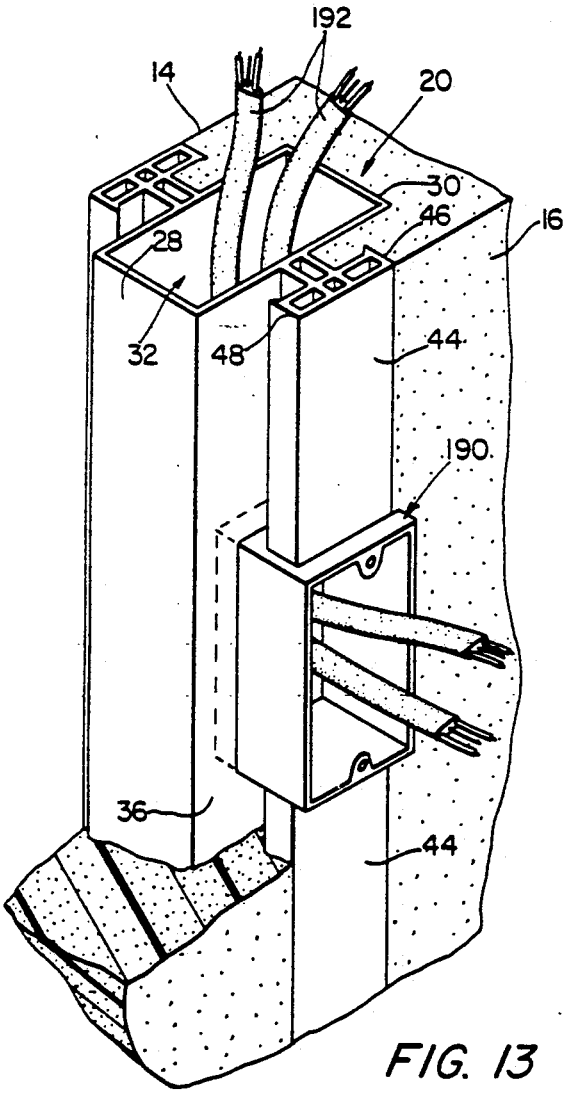
FIG. 13 is a perspective view, partially cut away, showing an electrical box and wiring inserted into a vertically disposed hollow column.
Figure 14:
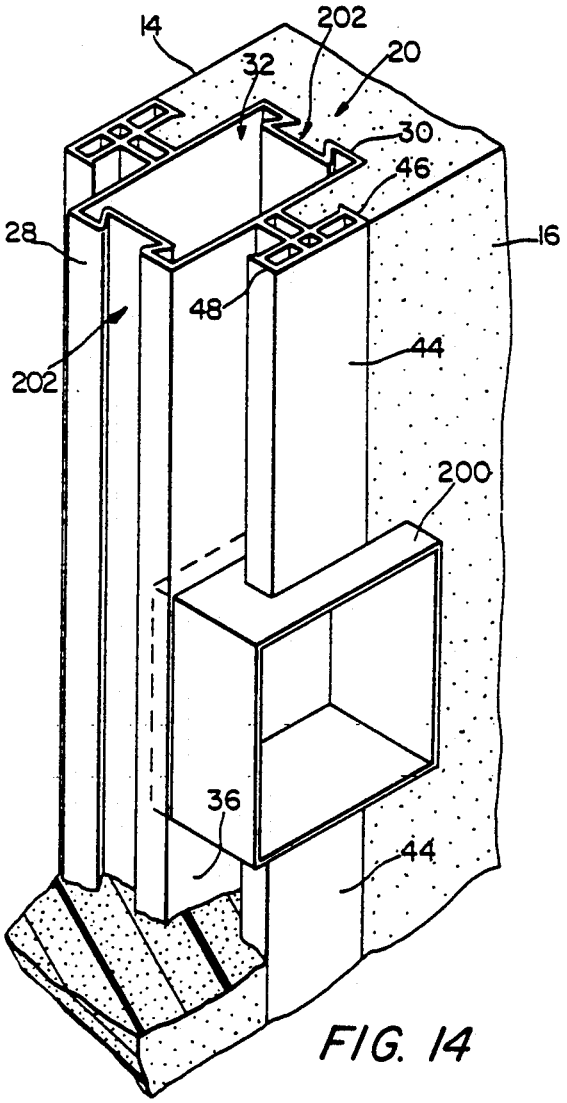
FIG. 14 is a perspective view, partially cut away, showing the incorporation of an air duct into a vertically disposed hollow column having dovetail sides.

As shown in FIGS. 13 and 14, the hollow interior of the vertical columns 20 provides usable space for use as a conduit for electrical wiring, plumbing and, in certain cases, heating or air-conditioning ducts.

FIG. 13 shows an electrical box 190 inserted within outside face 36 of column 20. A portion of box 190 is well within the open space 32 defined in the vertical column. Conventional household wiring 192 is shown passing through the volume 32 in the vertical column 20 and then into the interior of the electrical box for subsequent connection to conventional receptacles and switches. The box may be made of a PVC plastic and secured within the hollow column 20 so that it actually becomes part of the stud conduit. Alternatively, an opening may be cut on either side of the vertical column at any height and a box may be then introduced into the open space. The wire cables 192 may pass from location to location by entering and exiting holes (not shown) defined in the bottom and top plates 58 and 78.

FIG. 14 shows a vertical column 20 which has been cut on one of its faces to receive a box 200 in order to provide an exit point for air to pass through the vertical column. In this way, the volume 32 defined in the vertical column provides a duct work and the box 200 defines an air supply outlet. It is contemplated that the hollow conduits may be used in conjunction with equipment sold by Dunham Bush, Inc. under the trademark SPACE PACK. FIG. 14 also shows an alternate construction for the side walls 30 of the embodiment shown in FIG. 2. In particular, an elongated vertically extending mortis shape 202 is defined along the outer faces 28 and 30. The mortis indentation allows foam to form and act as a tenon, giving better bond of foam to the stud.

Thus it can be appreciated that a construction system employing the teachings of the present invention makes optimum use of an exterior wall construction module and assembly technique that includes a one-piece load-bearing exterior wall fabricated from light-weight foam surrounding load-bearing columns. The same construction technique may be used to produce walls for interior construction.

The modular panels 10 made in accordance with the teachings of the present invention enjoy several advantages. The individual wall panels may be pre-cast and molded in a factory setting away from the construction site. The wall units may be delivered as light-weight panels thus conserving both energy and transportation. Because of the way the panels are constructed, they are ready for easy erection using ordinary tools.

Each modular wall panel 10 includes a core 12 of expanded or foamed polymeric material which exhibits a high strength to weight ratio. The walls also exhibit super insulating properties especially because of the use of a continuous length and width of foamed material completely surrounding and touching the vertically oriented support columns 20. In addition, the hollow, vertical columns provide an excellent way to conceal wiring, plumbing and heating or cooling duct work. There is also a significant reduction in the number of wooden studs used in the construction.

From the above, it is apparent that many modifications and variations of the present invention are possible in light of the above teachings. It is therefore to be understood that, within the scope of the appended claims, the invention may be practiced otherwise than as specifically described.

I claim:

1. A structural column assembly for use as a structural support element to join two modular wall units together end-to-end, each of said wall units having an exterior surface and an interior surface, said column assembly comprising:

first and second end columns, each of said end columns having a pair of opposed planar side walls having a distal end and a proximal end and a planar end wall joining said proximal ends of each of said pairs of side walls into a generally U-shaped member, each of said pairs of side walls being arranged to be generally parallel with the exterior and interior surfaces of said wall units, each of said planar side walls having an inside face and an outside face, each of said outside faces having a primary leg extending outwardly from said distal end, said primary leg defining an elongated planar wall generally perpendicular to said outside face and having a termination at a predetermined transverse distance from said outside face, a planar outside vertical strip positioned at said termination of said primary leg generally parallel to said outside face along the full length of said end column and having a free end, said planar strip terminating along said free end in an inwardly directed finger, and a planar inside vertical strip positioned generally parallel and spaced from said planar outside vertical strip joining said primary leg to said finger, said end columns defining an interior space when said planar walls defined by said primary legs are placed into intimate contact with each other; and insert means for insertion into said interior space for securing said end columns to each other.

2. The column assembly of claim 1, said insert means comprising a pair of opposed planar side walls having a distal end and a proximal end and a planar end wall joining said proximal ends of said side walls into a generally U-shaped member, said insert means being sized to fit snugly within said interior space.

3. The column assembly of claim 1, each of said outside faces further having a second leg extending outwardly therefrom parallel to said primary leg and offset from said distal end of said side wall, said second leg joining said inside vertical strip at a right angle thereto.

4. The column assembly of claim 1, said inside faces of said side walls of each of said end columns being provided with barbs extending the length of each of said end columns, said barbs being angled towards said end walls of each of said end columns, and said insert means having longitudinal barbs thereon positioned to lockingly engage said barbs on said end columns when said insert means is inserted into said interior space.

5. The column assembly of claim 4, said insert means comprising an elongated longitudinal member having an ellipsoidal transverse cross-section and an outer surface having a pair of substantially planar, parallel side sections, said longitudinal barbs extending outwardly from said side sections.

6. The column assembly of claim 5, said interior space having an end-to-end dimension and said insert means having an exterior end-to-end dimension, said end-to-end dimension of said interior space being slightly smaller than said exterior end-to-end dimension of said insert means.

7. The column assembly of claim 4, each of said outside faces further having a second leg extending outwardly therefrom parallel to s id primary leg and offset from said distal end of said side wall, said second leg joining said inside vertical strip at a right angle thereto.

8. A construction column for use as a structural support element in a modular wall having an exterior surface and an interior surface, said column comprising:

an elongated, hollow sleeve having a longitudinal axis and a rectangular transverse cross-section, said sleeve having a pair of opposed planar side walls and a pair of opposed planar end walls, said side walls being arranged to be generally parallel with the exterior and interior surfaces of said modular wall, each of said side walls having an inside face and an outside face, each of said outside faces having a pair of parallel, spaced-apart primary legs extending outwardly therefrom, each of said primary legs defining an elongated planar wall generally perpendicular to said outside face and having a termination at a predetermined transverse distance from said outside face, a pair of parallel planar outside vertical strips, each of said outside vertical strips having a pair of opposed free ends and terminating along said free ends in respective inwardly directed fingers, each of said outside vertical strips being positioned at said terminations of one of said pairs of primary legs generally parallel to said outside face along the full length of said structural column and having a pair of opposed free ends, and a pair of parallel planar inside vertical strips, each of said inside vertical strips being positioned generally parallel to and spaced from one of said outside vertical strips and having a pair of opposed free ends, said inside and outside vertical strips being joined at their free ends by said inwardly directed fingers extending from said free ends of said outside vertical strip.

9. The construction column of claim 8, wherein said column is made from plastic.

10. The construction column of claim 9, wherein said plastic is PVC.

11. The construction column of claim 8, wherein said hollow sleeve when viewed in cross-section is in the form of a rectangle.

12. The construction column of claim 8, wherein said hollow sleeve comprises two separable portions, and wherein said construction column further comprises insert means for insertion into said hollow sleeve for securing said separable portions to each other.

* * * * *